US006227119B1

(12) United States Patent
Schmacker

(10) Patent No.: US 6,227,119 B1
(45) Date of Patent: May 8, 2001

(54) LIGHTWEIGHT WARHEAD ASSEMBLY

(75) Inventor: Bruce E. Schmacker, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/182,206

(22) Filed: Oct. 30, 1998

(51) Int. Cl.[7] ..... F42B 12/04
(52) U.S. Cl. ..... 102/473
(58) Field of Search ..... 102/501, 473, 102/529

(56) References Cited

U.S. PATENT DOCUMENTS

| | | | | |
|---|---|---|---|---|
| 4,517,897 | * | 5/1985 | Kneubuhl | 102/439 |
| 4,807,533 | * | 2/1989 | Von Entress-Fursteneck | 102/489 |
| 4,895,077 | * | 1/1990 | Miethlick et al. | 102/517 |
| 4,991,513 | * | 2/1991 | Malamas et al. | 102/481 |
| 5,054,399 | * | 10/1991 | Bilek et al. | 102/481 |
| 5,299,501 | * | 4/1994 | Anderson | 102/364 |
| 5,698,814 | * | 12/1997 | Parsons et al. | 102/478 |
| 5,939,662 | * | 8/1999 | Bootes et al. | 102/473 |

* cited by examiner

*Primary Examiner*—Thomas Price
(74) *Attorney, Agent, or Firm*—Burns, Doane, Swecker & Mathis, LLP

(57) ABSTRACT

The present invention is devoted to providing projectiles which can be configured as relatively lightweight warhead assemblies that are comparable to heavier warhead assemblies in target-destruction effectiveness. In accordance with exemplary embodiments, the lightweight warhead assemblies can be more efficiently carried in greater numbers on, for example, aircraft platforms. Because these lightweight warhead assemblies can replace existing, larger warhead assemblies, a standard size warhead assembly can be used to attack different types of targets. In addition, various submunitions or unitary warheads can be incorporated into payload containers having a common external shape with common aerodynamic and mass properties, as well as common guidance, sensor, fuzing, and mechanical and electrical interfaces. A standardized, or modular approach improves the interchangeability of various warhead assemblies, reduces costs of configuring and operating the aircraft platform, and enables a reduction in the size of internal weapon bays of aircraft platforms.

22 Claims, 8 Drawing Sheets

LIGHTWEIGHT WARHEAD ASSEMBLY

BACKGROUND OF THE INVENTION

1. Field of the Invention

The invention generally relates to projectiles, and more particularly, to lighter warhead assemblies which achieve levels of performance that are comparable to much heavier warhead assemblies.

2. State of the Art

The design of an effective penetrating projectile, such as a warhead, often involves balancing between competing requirements. A warhead must have adequate penetration, blast, and fragmentation performance to effectively destroy the intended target. One important factor in the design of a warhead is its mass. The greater the mass of the warhead, the greater force imparted to the target upon impact. However, the greater the mass of the warhead, the more difficult it is to deliver the warhead to the target, particularly with munitions carried by aircraft platforms. Warheads of relatively large mass require more fuel to carry, reduce maneuverability of the aircraft, occupy more space on the aircraft platform, appear more prominently on radar signatures, and must be carried in fewer numbers.

Existing relatively lightweight warhead assemblies having a weight on the order of 1,000 lbs. lack sufficient performance capabilities and can be ineffective against certain targets. Therefore, it is common to carry different warhead assemblies of varying sizes and configurations on aircraft platforms to accommodate different types of targets. These warheads are different in their aerodynamics, their mass, and their mechanical and electrical interfaces with the aircraft. These differences limit the flexibility of the aircraft platform to accommodate different weapon configurations, increase the cost of configuring and operating the aircraft, and require larger weapon bays to accommodate the warhead assemblies.

Accordingly, it would be desirable to provide projectiles which can accommodate different types of targets, but which avoid the drawbacks associated with delivering different warhead assemblies designed to accommodate different types of targets.

SUMMARY OF THE INVENTION

The present invention is devoted to providing projectiles which can be configured as relatively lightweight warhead assemblies that are comparable to heavier warhead assemblies in target-destruction effectiveness. In accordance with exemplary embodiments, the lightweight warhead assemblies can be more efficiently carried in greater numbers on, for example, aircraft platforms. Because these lightweight warhead assemblies can replace existing, larger warhead assemblies, a standard size warhead assembly can be used to attack different types of targets. In addition, various submunitions or unitary warheads can be incorporated into payload containers having a common external shape with common aerodynamic and mass properties, as well as common guidance, sensor, fuzing, and mechanical and electrical interfaces. A standardized, or modular approach improves the interchangeability of various warhead assemblies, reduces costs of configuring and operating the aircraft platform, and enables a reduction in the size of internal weapon bays of aircraft platforms.

Generally speaking, exemplary embodiments are directed to warhead assemblies including a main body portion and a substantially ogive-shaped end portion, the substantially ogive-shaped end portion having an external surface with a first radius of curvature and an internal surface having a second radius of curvature, a ratio of the first radius of curvature to the second radius of curvature being approximately 1.27–1.40, and a substantially cylindrical body portion.

BRIEF DESCRIPTION OF THE DRAWING FIGURES

Other objects and advantages of the present invention will become more apparent to those skilled in the art from reading the following detailed description of preferred embodiments in conjunction with the accompanying drawings, wherein like elements have been designated with like reference numerals, and wherein.

DETAILED DESCRIPTION OF THE PREFERRED EMBODIMENTS

Figure 1:
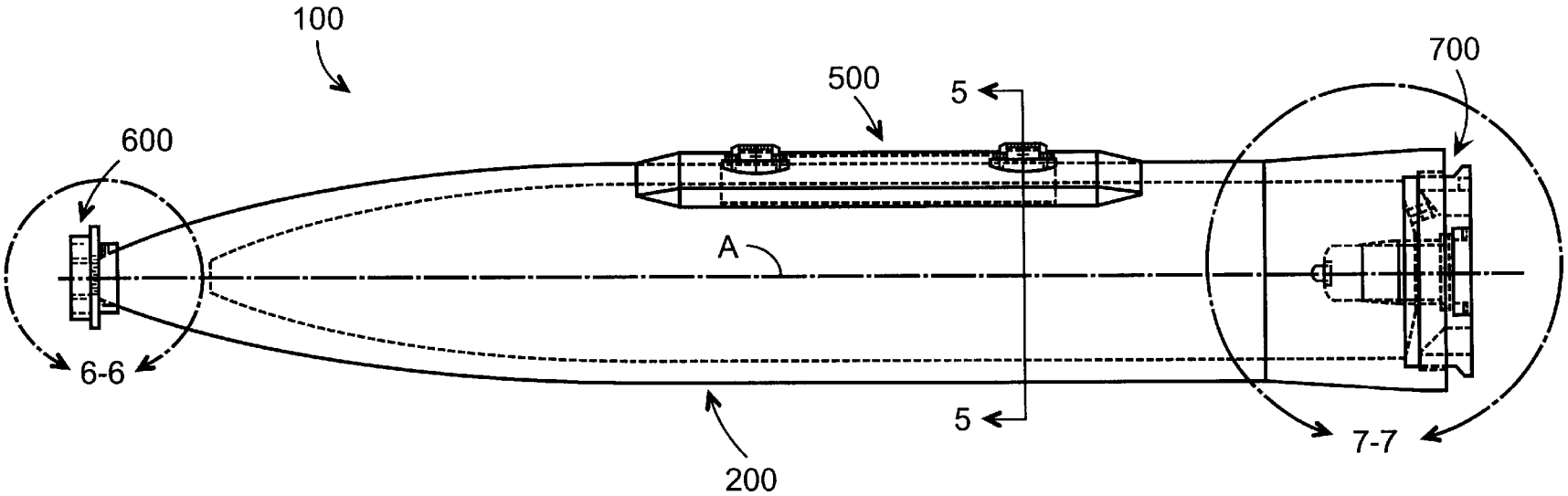
FIG. 1 is a side view of a warhead assembly constructed according to an exemplary embodiment of the present invention.

FIG. 1 illustrates an exemplary warhead assembly 100 constructed according to the principles of the present invention. The warhead assembly 100 includes a warhead casing 200 having a longitudinal axis A, a hardback assembly 500, a retaining member 600, and a fuse assembly 700.

Figure 2:
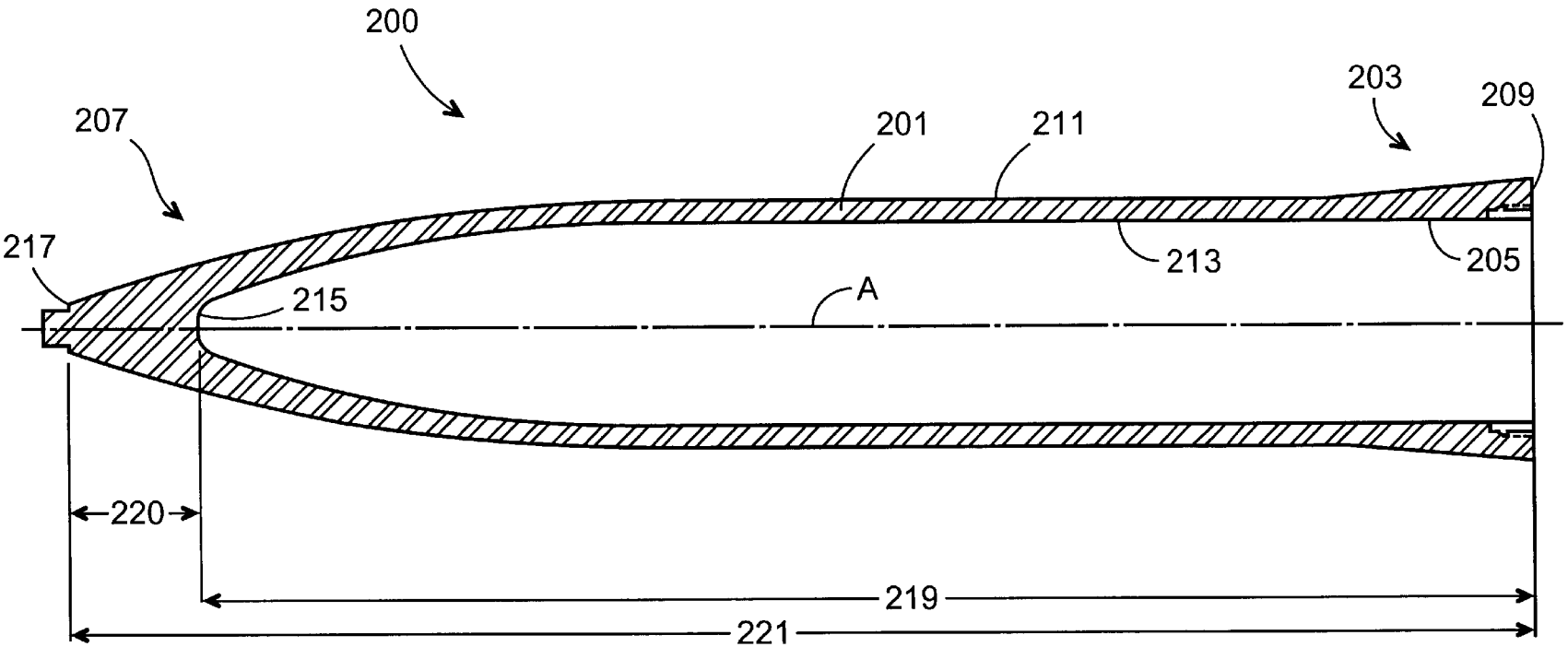
FIG. 2 is a cross-sectional view of the FIG. 1 warhead casing.

Referring to FIG. 2, the warhead casing 200 comprises a generally cylindrical main body portion 201, a first open-end portion 203 defining a bore 205, and a second substantially ogive-shaped closed end portion 207. The main body portion together with the first and second end portions define a substantially continuous exterior peripheral surface 211 and interior surface 213.

The internal longitudinal dimension of the warhead casing 200 is indicated by reference numeral 219, and is measured from a first substantially flat end surface 209 at first end portion 203 to a second substantially flat interior end surface 215 defined at second end portion 207. The external longitudinal dimension of the warhead casing 200 is indicated by reference numeral 221, and is measured from the first end surface 209 to a second exterior end surface 217 located at second end portion 207.

The longitudinal distance between the second interior end surface 215 and the second exterior end surface 217 constitutes a solid section of the second end portion 207 which is indicated by reference numeral 220, and which corresponds to the difference between the internal longitudinal dimension and external longitudinal dimension. The extent of this solid section of second end portion 207 is an important factor in defining the mass distribution and penetrability of the warhead casing 200. In an exemplary embodiment, the ratio of the longitudinal extent 220 of this solid section over the external longitudinal dimension 221 is on the order of 0.084–0.086, but can be any other specified ratio depending upon desired performance characteristics.

Figure 3:
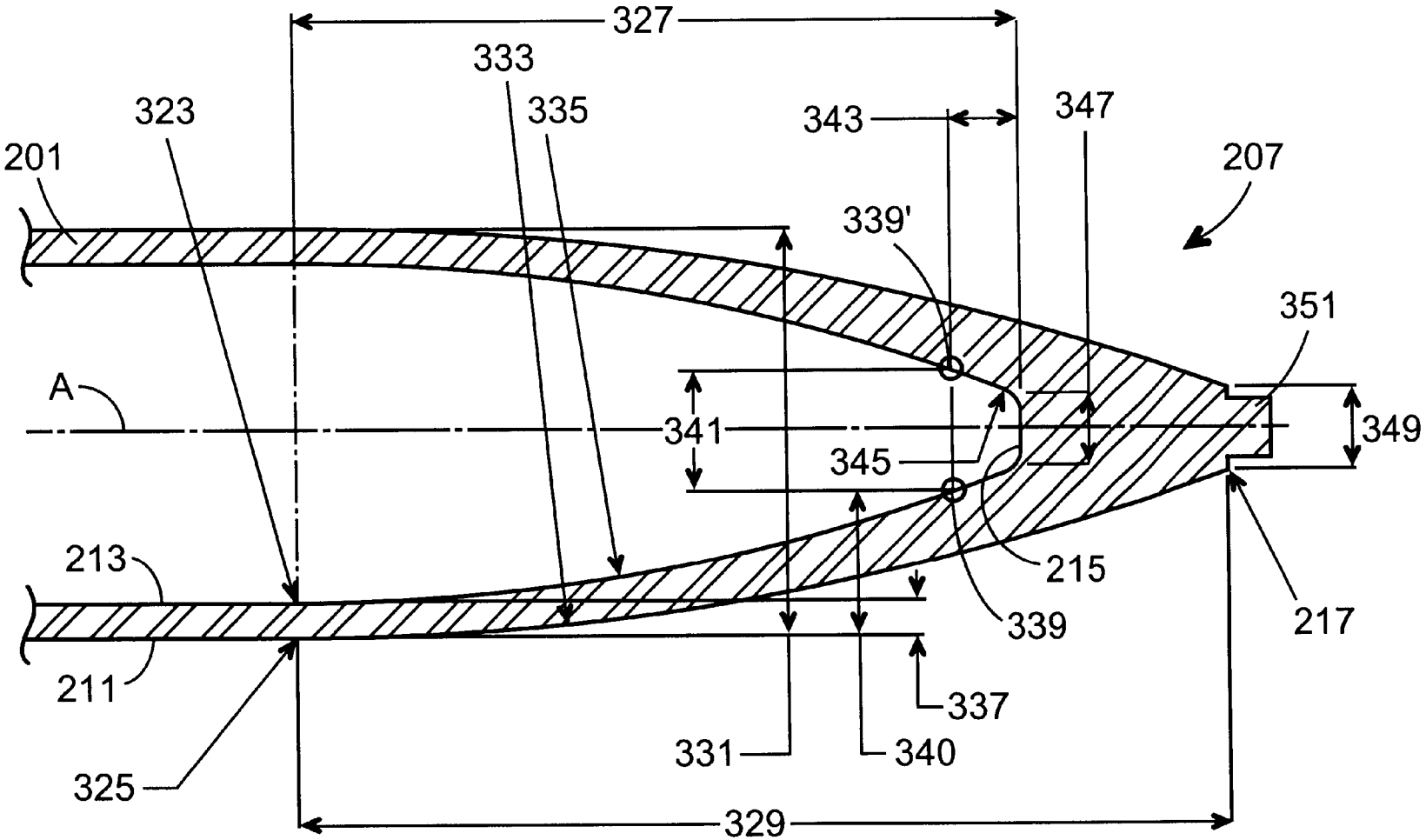
FIG. 3 is an enlarged partial cross-sectional view of the FIG. 2 warhead casing.

Other features of the second substantially ogive-shaped end portion 207 are illustrated in FIG. 3. A first interior tangent point 323 and a first exterior tangent point 325 are defined along interior surface 213, and exterior surface 211, respectively, in an area of transition between the main generally cylindrical body portion 201 and the substantially ogive-shaped second end portion 207. The first and second tangent points 323 and 325 are located at a predetermined longitudinal distance 327 from the second interior end surface 215, and are spaced from the second exterior end surface 217 by a predetermined longitudinal distance 329.

The location of tangent points 323 and 325, as defined by longitudinal dimensions 327 and 329, corresponds to the extent of longitudinal elongation of the ogive shape possessed by second end portion 207. In one embodiment, the ratio of longitudinal dimension 329 to longitudinal dimension 221 of the warhead casing 200 is on the order of 0.38, but can be any specified ratio depending on desired performance characteristics. This relative dimensioning is indicative of the longitudinal dimensions or elongation of the ogive-shaped second end portion 207 relative to the overall longitudinal dimension of the warhead casing 200, and has been shown to provide advantageous results.

The outer diameter of the warhead casing 200, as measured at the FIG. 3 tangent points 323 and 325, is indicated by reference numeral 331. As illustrated in FIG. 3, the warhead casing 201 curves inwardly or gradually converges, defining a radius of curvature 333 along exterior surface 211, and a radius of curvature 335 along interior surface 213. The radial thickness 337 (the radial direction being normal to the longitudinal axis A) of the warhead casing 200 gradually increases in a direction from the first and second tangent points 323 and 325 toward the second end portion 207 as a result of a predetermined difference in the radii of curvature 333 and 335. In an exemplary embodiment, the ratio of the radius of curvature 333 over radius of curvature 335 is on the order of 1.27–1.40, but can be any other specified ratio depending on desired performance characteristics. These relative dimensions are indicative of the rate of increase in radial thickness of the warhead casing, and provide desirable thickness and mass distribution properties in accordance with an exemplary embodiment.

In a direction toward second end surface 217 of the second end portion 207, second interior tangent points 339 and 339' are disposed along interior surface 213 and are located a predetermined longitudinal distance 343 from the second interior end surface 215. Tangent point 339 is also a predetermined radial distance 340 from the portion of exterior surface 211 located at exterior tangent point 325. Tangent points 339 and 339' are separated by a predetermined radial separation 341.

The portion of interior surface 213 extending between tangent points 339 and 339' to second interior flat surface 215 constitutes a substantially curved surface having a radius of curvature 345. The second interior end surface 215 is defined by radial dimension 347. The extent of radial dimension 347 helps define the interior shape and the mass distribution properties of warhead casing 200.

The second exterior end surface 217 is defined by a predetermined radial dimension 349. The extent of radial dimension 349 helps define the exterior shape and the mass distribution properties of warhead casing 200.

In an exemplary embodiment, the warhead casing 200 further comprises a threaded nose portion 351 extending longitudinally from the second exterior end surface 217.

Figure 4:
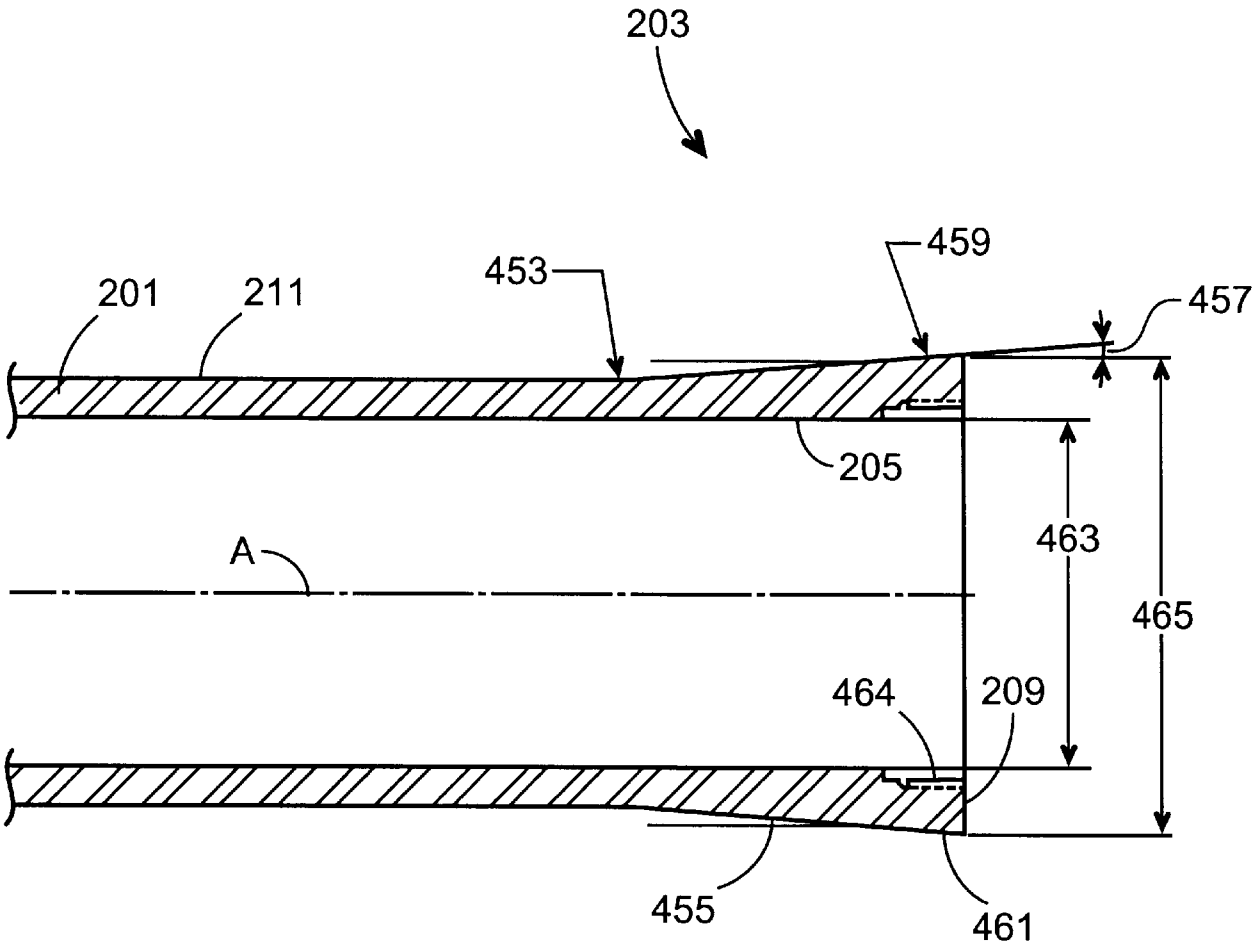
FIG. 4 is an enlarged partial cross-sectional view of the FIG. 2 warhead casing.

Certain details of the first open end portion 203, of warhead casing 200 will now be described by reference to FIG. 4. As the main body portion 201 extends toward the first end surface 209, a transition portion having a predetermined radius of curvature 453 is defined along exterior surface 211. A sloped surface 455 connects the transition portion defined by radius of curvature 453 with a second transition point 459. Sloped surface 455 defines a predetermined angle 457 relative to the longitudinal direction. A substantially flat surface 461 extends from second transition point 459 to the second flat end surface 209.

The first end portion 203 defines a bore 205 having an inner diameter 463. Similarly, substantially flat surface 461 defines an outer diameter 465. By this construction, first end portion 203 is strengthened thereby permitting connection of various accessories, such as a booster section, to the warhead casing 200.

Warhead casing 200 can be constructed of any suitable high strength material. For example, the warhead casing can be constructed of a heat treatable alloy steel. In an exemplary embodiment, the heat treatment is carried out to military specification MIL-H-6875, CL A. A suitable heat treated alloy steel will have a yield strength of approximately 170,000 psi or more, an ultimate strength of approximately 180,000 to 200,000 psi, or more, Charpy V-notch impact resistance at −40°(+/−) 2° Farenheight of approximately 20 ft.-lb. on 3 per section, with a 15 ft.-lb. minimum, or more, and a Brinnel hardness number (BHN) of approximately 375 to 415, or more. By way of example, one suitable heat treatable alloy is AISI 4335 steel.

The overall shape and dimensions of the warhead casing 200 are an important factor in achieving the desired objectives of the present invention. The following dimensions and ratios are given as an illustration of one exemplary embodiment of a warhead casing constructed according to the principles of the present invention.

| Dimension | Value (in inches, unless otherwise indicated) |
|---|---|
| 219 | 64.52–64.64 |
| 220 | 5.94–6.06 |
| 221 | 70.52–70.64 |
| 327 | 21.011–21.031 |
| 329 | 27.011–27.031 |
| 331 | 11.50–11.70 |
| 333 | 80.99–81.01 |
| 335 | 58.0–64.0 |
| 337 | 0.94–1.06 |
| 340 | 4.02–4.18 |
| 341 | 3.38–3.44 |
| 343 | 1.97–2.03 |
| 345 | 0.45–1.05 |
| 347 | 1.984–2.004 |
| 349 | 2.310–2.330 |
| 457 | 2.5 0 6.5 degrees |
| 463 | 9.57–9.63 |
| 465 | 12.97–13.03 |

-continued

| Dimension | Value (in inches, unless otherwise indicated) |
|---|---|
| Ratio | Value |
| 333/335 | 1.27–1.40 |
| 220/221 | 0.084–0.086 |
| 329/221 | 0.382–0.383 |

A warhead assembly incorporating a warhead casing constructed in accordance with exemplary embodiments of the present invention provides numerous advantages. For example, by controlling the forward exterior and interior shape of the warhead casing, the particular thicknesses and variations in thicknesses of the warhead casing, and mass distribution, a warhead can be provided with exceptional structural strength, enabling survival of the warhead upon impact with hardened structures. The shape of the warhead casing enables penetration of hard materials such as rock or concrete to a greater depth than other warheads weighing on the order of 2,000 pounds, and to a depth that exceeds certain existing 1,000 pound class warheads.

Figure 5:
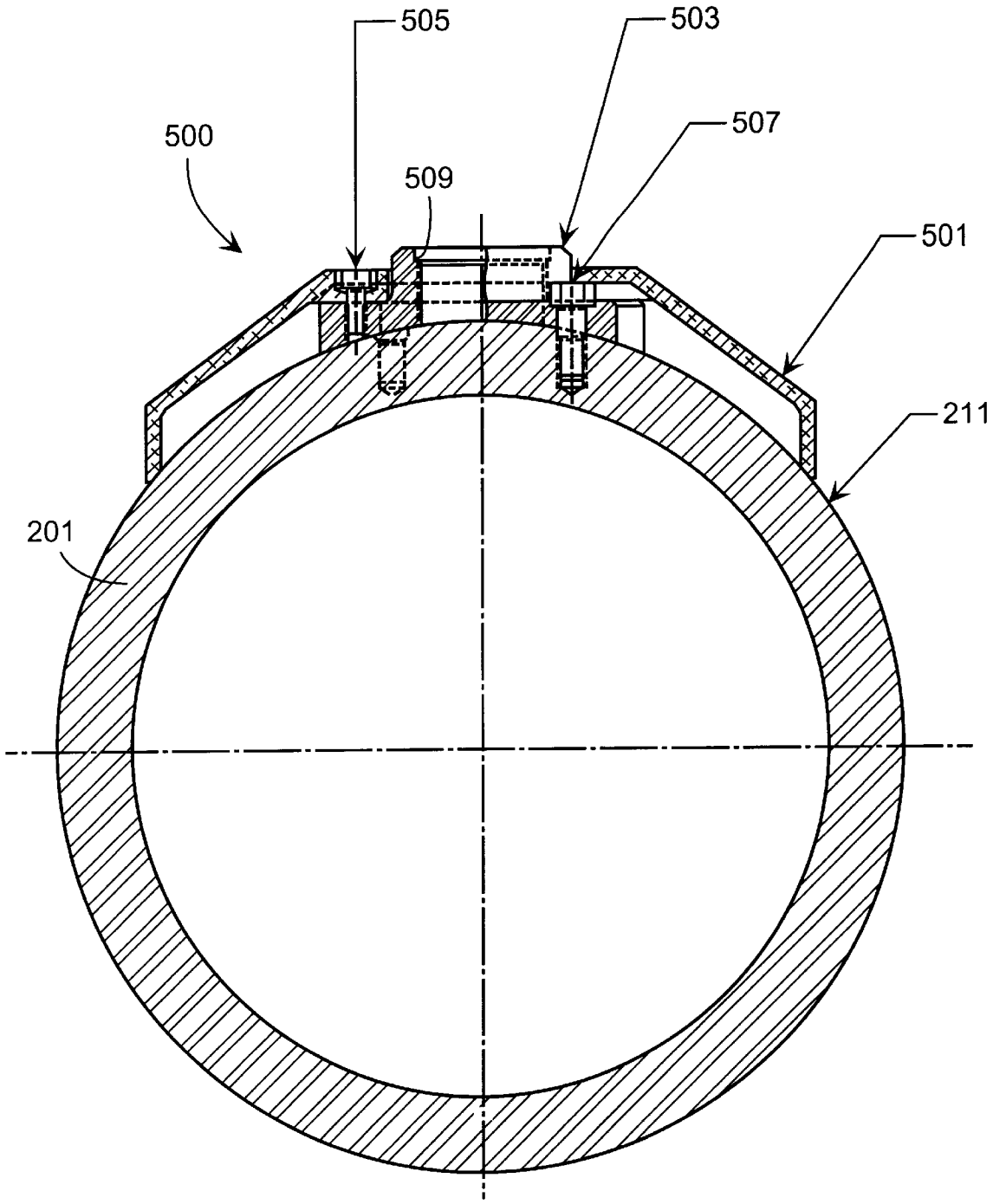
FIG. 5 is a cross-sectional view taken along line 5—5 of FIG. 1.

FIG. 5 illustrates details of an exemplary hardback assembly 500 which can be mounted to the warhead casing 200. Hardback assembly 500 includes a hardback plate 501. The hardback plate 501 can be constructed of any suitable material, such as high strength aluminum alloy material. Hardback plate 501 is connected to an adaptor lug 503 by a suitable fastener member, such as a threaded bolt 505. Adaptor lug 503 can also be constructed of any suitable material, such as a heat-treated alloy steel. Adaptor lug 503 is connected to the warhead casing by a suitable threaded fastener member, such as threaded bolt member 507. Adapter lug member 503 defines an opening having a counter bore 509 disposed therein.

Hardback assembly 500 facilitates mounting of the warhead assembly 100 to a suitable launch platform, such as an aircraft, as known in the art.

Figure 6A:
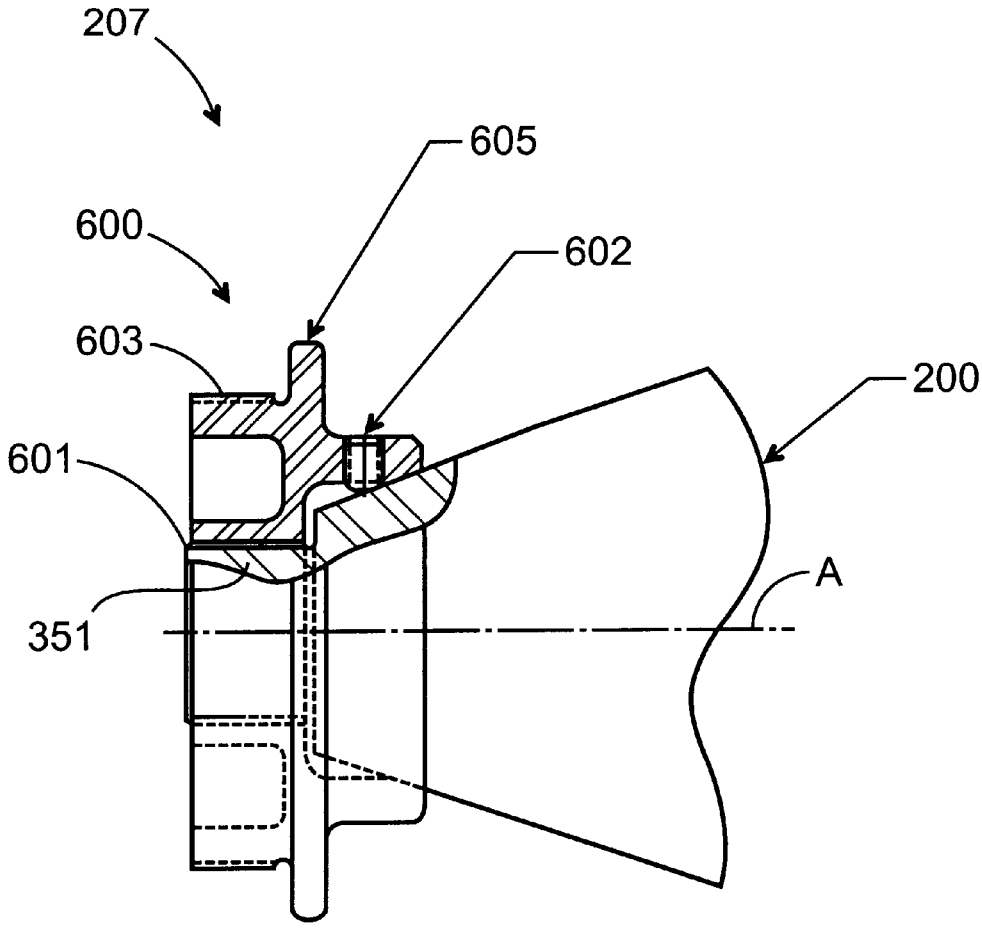
FIG. 6A is an enlarged partial cross-sectional view of the FIG. 1 area 6—6.

As illustrated in FIG. 6A, a retaining member 600 is threadably received about the threaded nose portion 351 of warhead casing 200. Retaining 600 includes a threaded internal bore 601 which mates with the exterior threading of nose member 351 of the warhead casing 200. Once threaded over nose member 351, a set screw 602 acts to fix the position of retaining member 600 relative to the warhead casing 200. Retaining member 600 further includes an external threaded surface 603 and upstanding flange member 605. Retaining member 600 can be formed of any suitable material, such as an alloy steel.

Figure 6B:
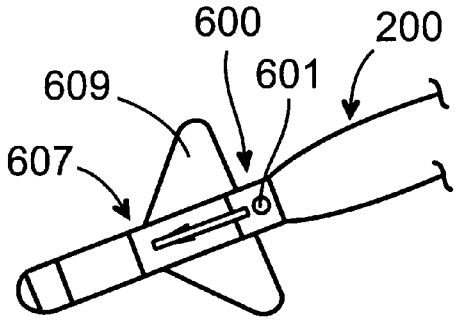
FIG. 6B is a top view of a warhead assembly including a guidance kit according to an exemplary embodiment of the present invention.

By this construction a retaining bolt member 600 permits attachment of various accessories to the second end portion 207 of the warhead casing 200. As illustrated in FIG. 6B one such accessory is a guidance kit 607. Guidance kit 607 includes means to generate signals which guide the flight path warhead assembly 100. Any suitable guidance system can be used in conjunction with the present invention. Suitable guidance systems include active or semi-active laser guided systems, such as those used in a guided bomb unit (GBU-24) and (GBU-27), produced by Raytheon Corporation. Other guidance systems which can be used include a combined global positioning system/inertial navigation system (GPS/INS), which is known in the art.

Guidance kit member 607 may be attached to the warhead casing 200 via retaining member 600 in any suitable fashion. For example, a rear section of guidance kit member 607 can be threadably received over external threaded surface 603 of retaining member 600. Guidance kit member 607 can further include one or more stabilizing and/or steering air vane members 609.

Figure 7:
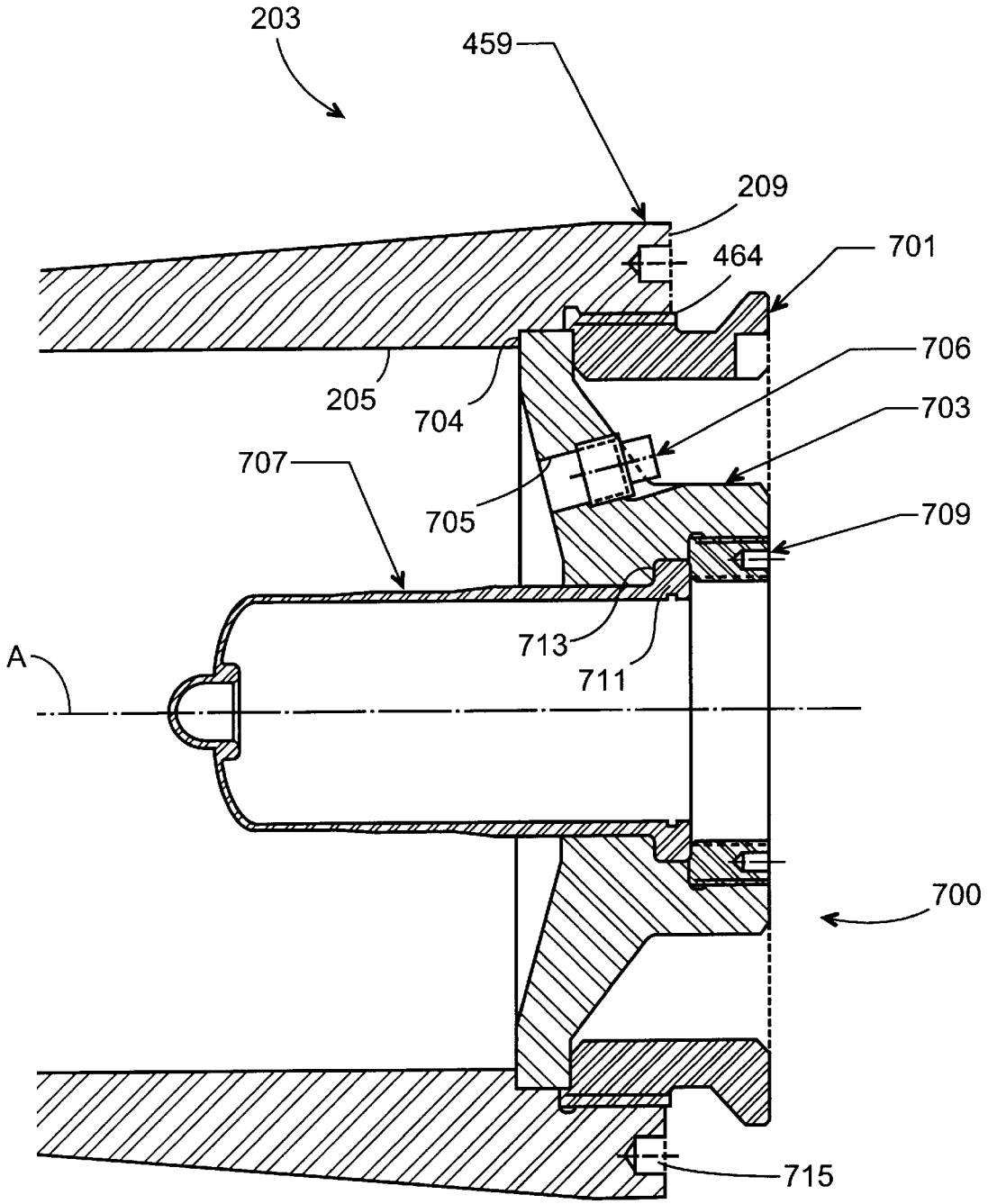
FIG. 7 is a partial, enlarged cross-sectional view of the FIG. 1 area 7—7.

At the opposite first end 203 of the FIG. 2 warhead casing 200, a fuse assembly 700 of the exemplary FIG. 7 embodiment is at least partially received within bore 205 of the first end 203. In the exemplary embodiment shown in FIG. 7, an aft closure retaining ring 701 is received within threaded counter bore 464 thereby retaining the fuse assembly 700 in its proper position.

Aft closure 703 is positively engaged by the aft closure retaining ring 701. An opposite side of the aft closure is engaged by a shoulder 704 formed along bore 205. By this construction, the aft closure 703 is positively located and retained in its proper position. Aft closure 703 is provided with one or more openings 705 which are closed by a threaded plug member 706. A fuse liner 707 is received within the aft closure 703. A fuse liner retaining flange 711 is provided at one end of the fuse liner 707 and is received upon a shoulder 713 formed along the interior of aft closure 703. A fuse liner retaining ring 709 is threadably received within aft closure 703 and is threadably driven into positive engagement with fuse liner retaining flange 711. In this manner, fuse liner 707 is positively retained within aft closure 703.

In an embodiment of the present invention in which warhead casing 200 carries a payload material, fuse assembly 700 is provided to activate the payload material. Any suitable payload material can be carried within warhead casing 200, such as conventional or nuclear explosives, as well as agent-defeating materials such as incendiaries, chemicals or submunitions. The components of fuse assembly 700 can be constructed of any suitable material. A high strength, heat treated alloy steel is one such suitable material.

Figure 8:
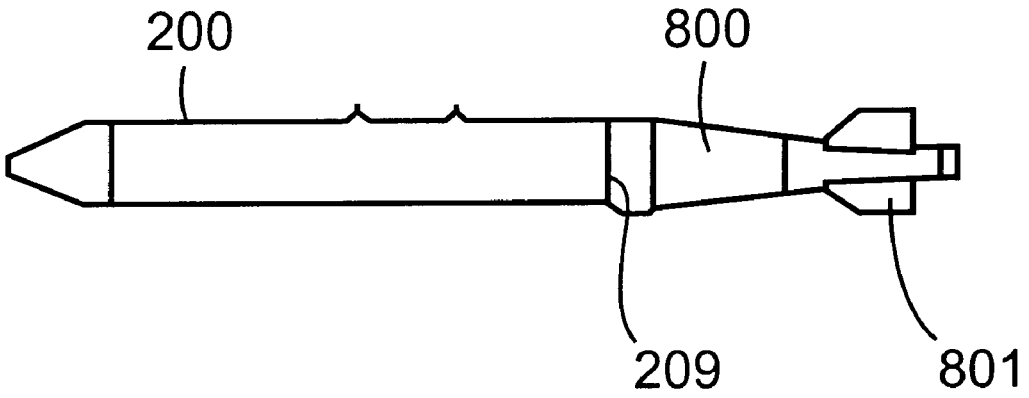
FIG. 8 is a side view of the warhead assembly of FIG. 1 including a tail section.

End surface 209 can be further provided with a plurality of blind bores 715. Bores 715 can serve as a means for attachment of an exemplary FIG. 8 tail section 800 to the warhead casing 200. As illustrated in FIG. 8, tail section 800 can be attached to the end surface 209. The tail section 800 can include a suitable booster device. For example, a rocket booster motor can be incorporated in the tail section 800. Tail section 800 can further include stabilizing and/or control vanes 801. In an alternate embodiment, an appropriate guidance system can be mounted within tail section 800, rather than through the FIG. 3 threaded nose member 351.

According to the principles of the present invention, the exemplary warhead assembly 100 can have a total weight on the order of 900–1,000 lbs. (with approximately 250 lbs. of payload materials), or any specified weight for a given payload, and still possess the penetration and destructive capabilities comparable with warhead assemblies of greater weight. For example, the warhead having a weight on the order of 900–1,000 lbs. can have performance characteristics comparable to a warhead weighing on the order of 2,000 pounds. Such relatively lightweight warhead assemblies can be carried more efficiently and in greater numbers on launch platforms. These relatively lightweight warhead assemblies can be used to replace existing heavier warhead assemblies without significant sacrifice in effectiveness. This standardization or modular approach provides significant cost savings benefits over existing systems, and enables a reduction in the space occupied by the warhead assemblies on launch platforms.

Although the present invention has been described by reference to particular embodiments, it is in no way limited thereby. To the contrary, modifications and variants will be apparent to those skilled in the art in the context of the following claims.

What is claimed is:

1. A warhead assembly comprising:

a main body portion and a substantially ogive-shaped end portion, said substantially ogive-shaped end portion having an external surface with a first radius of curvature and an internal surface having a second radius of curvature, a ratio of the first radius of curvature to the second radius of curvature being approximately 1.27–1.40; and a substantially cylindrical body portion.

2. The warhead assembly of claim 1, further comprising:

an open end portion defining a bore and a first end surface;

a second external end surface and a second internal end surface defined by said substantially ogive-shaped end portion;

a first longitudinal dimension extending between said second internal end surface and said second external end surface; and a second longitudinal dimension extending between said first end surface and said second external end surface, a ratio of said first longitudinal dimension over said second longitudinal dimension being approximately 0.084–0.086.

3. The warhead assembly of claim 2, wherein said second internal end surface is a substantially flat surface having a second radial dimension, said second radial dimension being approximately 1.984–2.004 inches.

4. The warhead assembly of claim 2, wherein said second external end surface is a substantially flat surface having a third radial dimension, said third radial dimension being approximately 1.984–2.004 inches.

5. The warhead assembly of claim 2, further comprising:

a threaded nose member extending longitudinally from said second external end surface.

6. The warhead assembly of claim 5, further comprising:

a retainer bolt threadably received about said threaded nose member.

7. The warhead assembly of claim 6, further comprising:

a guidance kit connected to said retainer bolt.

8. The warhead assembly of claim 7, wherein said guidance kit further includes:

a guidance system chosen from the group consisting of: an active laser-based system, a semi-active laser-based system, and a GPS/INS-based system.

9. The warhead assembly of claim 2, wherein said open end portion further includes:

a first transition portion having a predetermined radius of curvature, a sloped surface extending from said first transition portion to a second transition point, and a substantially flat surface extending from said second transition point to said first end surface.

10. The warhead assembly of claim 2, further comprising:

a fuse assembly, said fuse assembly being at least partially received within said bore of said open end portion.

11. The warhead assembly of claim 10, wherein said fuse assembly further includes:

a fuse liner, said fuse liner being received within an aft closure ring;

a fuse liner retaining ring engaged with said fuse liner to retain said fuse liner in position; and an aft closure ring threadably received within said bore and in engagement with said aft closure ring to retain said aft closure ring in position.

12. The warhead assembly of claim 2, further comprising:

a tail section attached to said first end surface, said tail section including a booster for powering said warhead assembly.

13. The warhead assembly of claim 19, wherein said tail section further comprises: a guidance system, said guidance system being chosen from the group consisting of: an active laser-based system, a semi-active laser-based system, and a GPS/INS-based system.

14. The warhead assembly of claim 1, further comprising:

a first internal tangent point along said internal surface, and a first external tangent point along said external surface, each of said first tangent points being located at an area of transition between said substantially cylindrical body portion and said substantially ogive-shaped end portion; and a third longitudinal dimension defined between said first tangent points and said second external end surface, a ratio of said third longitudinal dimension over said second longitudinal dimension is approximately 0.382–0.383.

15. The warhead assembly of claim 14, further comprising:

a radial thickness measured at said first internal and external tangent points of approximately 0.94–1.06 inches, said radial thickness gradually increasing in a direction toward said second external end surface.

16. The warhead assembly of claim 14, further comprising: an outer diameter measured at said first internal and external tangent points, said outer diameter being approximately 11.50–11.70 inches.

17. The warhead assembly of claim 16, further comprising:

a plurality of blind bores disposed in said first end surface.

18. The warhead assembly of claim 1, wherein said main body portion is formed from a heat-treated steel material and has a yield strength of approximately 170,000 psi or more, an ultimate strength of approximately 180,000 psi or more, a Charpy V-notch impact strength of approximately 20 ft.-lb. or more, and a Brinnel hardness number of approximately 375–415, or more.

19. The warhead assembly of claim 1, wherein said warhead assembly has a total weight of approximately 1,000 lbs. or less.

20. The warhead assembly of claim 1, further comprising:

a hardback assembly having a hardback plate and an adapter lug, said hardback plate being attached to said adapter lug, and said adapter lug being attached to said main body portion.

21. A warhead casing comprising:

a main body portion and a substantially ogive-shaped end portion, said substantially ogive-shaped end portion having an external surface with a first radius of curvature and an internal surface having a second radius of curvature, a ratio of the first radius of curvature to the second radius of curvature being approximately 1.27–1.40; and a substantially cylindrical body portion.

22. The warhead casing of claim 21, further comprising:

an open end portion defining a bore and a first end surface;

a second external end surface and a second internal end surface defined by said substantially ogive-shaped end portion;

a first longitudinal dimension extending between said second internal end surface and said second external end surface; and a second longitudinal dimension extending between said first end surface and said second external end surface, a ratio of said first longitudinal dimension over said second longitudinal dimension being approximately 0.084–0.086.

* * * * *